United States Patent [19]

Jartoux

[11] Patent Number: 4,693,044

[45] Date of Patent: Sep. 15, 1987

[54] DEVICES FOR PRESTRESSING CONCRETE HAVING STRETCHED SINUOUS CABLES AND THE METHODS FOR IMPLEMENTING SAME

[75] Inventor: Pierre Jartoux, Epernon, France

[73] Assignee: Freyssinet International (Stup), Coignieres, France

[21] Appl. No.: 916,790

[22] Filed: Oct. 8, 1986

[30] Foreign Application Priority Data

Oct. 10, 1985 [FR] France ..... 83 15030

[51] Int. Cl.[4] ..... E04C 3/10; E04C 5/08

[52] U.S. Cl. ..... 52/230; 52/744

[58] Field of Search ..... 52/230, 226, 744

[56] References Cited

U.S. PATENT DOCUMENTS

| | | | |
|---|---|---|---|
| 4,069,677 | 1/1978 | Yamada et al. | 52/230 X |
| 4,473,915 | 10/1984 | Finsterwalder | 52/230 X |
| 4,505,081 | 3/1985 | Dinis et al. | 52/230 X |

FOREIGN PATENT DOCUMENTS

| | | |
|---|---|---|
| 2112802 | 6/1972 | France . |
| 2511721 | 2/1983 | France . |
| 8317485 | 11/1983 | France . |

*Primary Examiner*—Alfred C. Perham

*Attorney, Agent, or Firm*—Fleit, Jacobson, Cohn & Price

[57] ABSTRACT

The invention relates to the prestressing of a concrete work by means of a relatively long stretched sinuous cable (1) formed by a bundle of several metal strands (2)housed individually in plastic material tubes (3). The different tubes with their strands are positioned without special precautions in a sheath (5) buried in the work then a sufficiently unctuous and fine cement grout (6) is injected into this sheath for filling the spaces in the sheath between the tubes and strands are tensioned individually after solidification of the injected cement grout, by means of relatively light automatically operated actuating cylinders.

2 Claims, 3 Drawing Figures

DEVICES FOR PRESTRESSING CONCRETE HAVING STRETCHED SINUOUS CABLES AND THE METHODS FOR IMPLEMENTING SAME

BACKGROUND OF THE INVENTION

The invention relates to devices for prestressing concrete works using relatively long stretched sinuous cables formed by bundles of several metal strands (simple or composite wires), which bundles are housed in sheaths themselves buried over at least a part of the length in the concrete works, more especially during casting of same.

It also relates to the methods for implementing these prestress devices.

It relates more particularly, among these devices and methods, to those for which each cable strand is itself contained in a plastic material tube with preferably interpositioning of grease.

It relates more particularly still to the case where the cables considered are intended to support high tension forces.

In such a case, it is particularly advantageous to be able to tension the cables strand by strand.

Such a measure in fact allows actuating cylinders or jacks to be used for such tensionings which are lighter and more compact than those required for tensioning in a single go, which allows generally available devices to be used for operating these actuating cylinders which lend themselves in particular to automated control.

To make such tensioning possible strand by strand, the different tubes must remain spaced apart transversely with respect to each other so as to avoid them rubbing against each other in their mutual contact positions, which would risk tearing them, placing the corresponding metal strands in direct contact and finally preventing the individual tensioning.

Since the cable considered is sinuous and not rectilinear, such transverse spacing of the different strands can only be obtained by providing special spacers in the sheath, at least at its bends.

These spacers, generally formed by ties or by moulded pieces recessed by as many housings as there are strands to be spaced apart, are relatively costly and difficult to position.

In French patent No. 2 511 721 of the applicant, it has been proposed to form a curved and highly prestressed cable section for connecting therebetween two rectilinear portions of a stretched cable, this section being itself formed by a bundle of parallel metal strands arranged in the way described above.

In other words, the bundle is contained in a sheath itself buried in a concrete mass, each strand is housed in a plastic material tube and the different strands are stretched while the tubes are held transversely spaced apart from each other in an arrangement organized by means of spacing members.

Furthermore, a solidifiable cement mortar is injected into the sheath after the tubes with their cable strands are positioned therein.

In this patent, the sheath is formed by a metal tubular section curved in the form of a single relatively short arc of a circle resisting axial compression so as to absorb the prestress tension exerted by the strands between its two ends and it has been proposed, for relieving the metal forming this tubular section during application of said prestress, to solidify the cement mortar before tensioning of the strands.

SUMMARY OF THE INVENTION

The present invention does not relate to such short and prestressed connecting sections, but to complete sinuous and relatively long cables for which the transverse arrangement of the different component strands does not remain "organized" along the whole of their extent, but is on the contrary irregular and disordered.

These strands, or more precisely the tubes which contain them, are in fact introduced into the corresponding, continuous or discontinuous, long and sinuous sheaths, by groups or individually, without any special precaution concerning their mutual spacing, which results in causing their mutual transverse arrangement along said sheath to vary or to be "disorganized", particularly by drawing the whole of the strands closer to the centres of curvature of the cable in the bent portions thereof, crossing some of these strands in a transverse direction, etc. . .

Therefore, recourse to preformed spacers is excluded and the local contacts of the different tubes with each other are inevitable: it might be thought that the individual tensioning of the strands forming such cables is not possible.

Now, the applicant has discovered that such a measure is made possible despite the length of the cables concerned and the disorder of their component strands, by using solely as mutual "spacer" of these disordered strands a cement grout injected into the sheath between the tubes, after positioning of these tubes in this sheath, said cement grout filling all the spaces between the tubes inside the sheath and being solidified before tensioning of the strands.

The cement grout in question must for this purpose be sufficiently unctuous and fine during injection thereof and it must be solidifiable only at the end of the injection through sufficiently delayed setting. Such cement grouts have for example been described in the French patents No. 70 40467 and No. 83 17485 of the applicant.

Besides this main arrangement, the invention comprises certain other arrangements which will preferably be used at the same time and which will be explicitly discussed hereafter.

In what follows, a preferred embodiment of the invention will be described with reference to the accompanying drawings in a manner which is of course in no wise limitative.

DESCRIPTION OF PREFERRED EMBODIMENT

Figure 1:
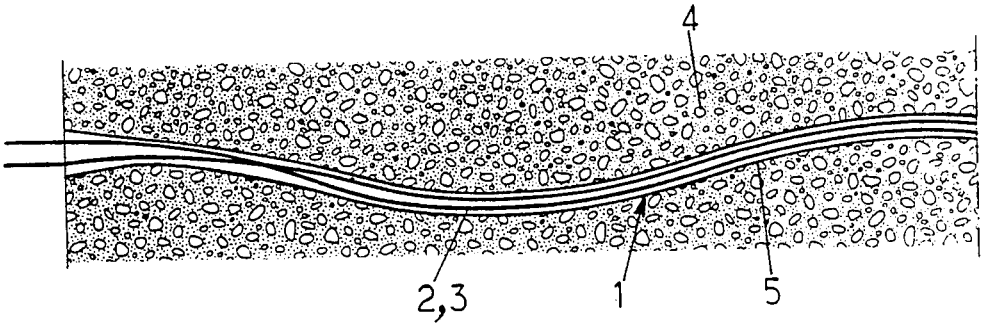
FIG. 1, of these drawings, shows schematically a portion of a sinuous prestressed cable positioned in its sheath, according to the invention, before injection of the cement grout and before tensioning of its strands.

The prestressed cable 1 here considered is formed of a plurality of metal strands 2 (simple or twisted wires) extending substantially parallel so as to form a bundle.

Each strand is housed in a plastic material tube 3 with interpositioning of grease or any other lubricating product, the lubricating properties of this product being either permanent or limited in time.

The cable considered is intended for prestressing a concrete work 4 in which is buried a sheath 5, made for example from polyethylene, this sheath having been positioned, with its final shape, in the shuttering of the work before casting of the concrete.

Said shape is sinuous in that it comprises a succession of several curved and/or rectilinear sections, and more particularly a succession of several sections curved in opposite directions.

The sheath considered may be continuous or discontinuous and then limited to concrete crossings, the unsheathed cable sections being rectilinear and external to the concrete.

For prestressing the work 4, the procedure is as follows.

Figure 2:
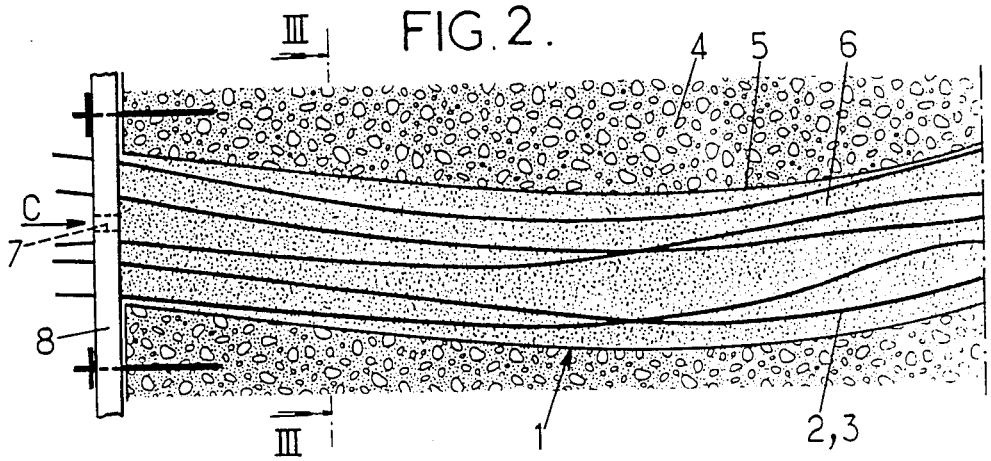
FIG. 2 shows schematically on a larger scale a portion of the same cable during injection of the cement grout.
Figure 3:
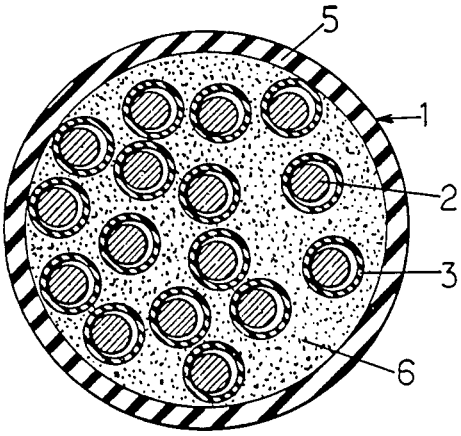
FIG. 3 is a cross-section of the finished cable on an even larger scale, through III—III of FIG. 2.

The different tubes 3 with strands 2 forming cable 1 are introduced into the sheath 5 through one of its open ends, without taking any special precautions, which generates in their transverse distribution a certain disorder as can be seen in FIGS. 1 and 2.

Then into sheath 5 is injected a cement grout 6 sufficiently unctuous and fine to fill the whole of the spaces between tubes 3 inside sheath 5, said cement grout being chosen so that setting thereof is sufficiently delayed so as to occur only after total filling.

The injection in question is made in the direction shown by arrow C (FIG. 2) through an aperture 7 passing through an appropriate cover 8 sealingly connected to the end concerned of sheath 5.

Final setting of the cement grout results in solidifying this latter and fixing the disorder of strands 2— or more precisely the irregular evolution of their transverse distribution along their extent— in the very condition in which they were to be found at the end of positioning thereof inside sheath 5.

After such setting, it is possible to tension each strand 2 separately.

In fact, tubes 3 are then jacketed over the whole of their length by the rigid mass of solidified cement grout 6 and they are totally locked by this mass while forming excellent reinforced guides for sliding of the metal strands against their internal surfaces.

It may even be contemplated that some of the tubes are in mutual contact two by two at a point or over certain lengths: even in this case, the cement grout is interposed between the two tubes considered on each side of their mutual contact zone while preventing relative movements thereof during tensioning of the individual strands.

Such tensioning of the cable strand by strand is made possible without recourse to any preformed spacer, despite the great length and the sinuous path of the cable.

Such tensioning allows very high value prestresses to be obtained, using relatively light tensioning cylinders, taking up little space and so easy to operate, in particular using means lending themselves to automatic control. In this latter case, the corresponding ends of the cable strands 2 may pass through the cover 8 in a predetermined regular distribution without the above-mentioned "disorganization" being suppressed for all that, which relates to the greatest length of the cable.

As is evident, and as it follows moreover already from what has gone before, the invention is in no wise limited to those of its modes of application and embodiments which have been more specially considered; it embraces, on the contrary, all variants thereof.

I claim:

1. A device for prestressing a concrete element comprising at least one elongated sinuous cable formed by a bundle of metal strands, the bundle being housed in an elongate sheath which is embedded over at least a part of its length in the concrete element, each cable strand being contained in a tube of plastic material and the tubes having a transverse distribution which is irregular within the cable, the tubes being fixed in their relative positions by means of a solidified cement grout filling spaces defined between the tubes and the inside of the sheath.

2. A method of making a device for prestressing a concrete element comprising providing the concrete element with at least one elongate sinuous sheath, inserting into the sheath a bundle of elongate metal strands each contained in a tube of plastic material, the strands being inserted in the sheath in an irregular distribution transversely of the sheath, injecting into the sheath a cement grout to embed the tubes therein when the grout has solidifed and, after solidification of the grout, tensioning the strands individually.

* * * * *